US005669588A

United States Patent [19]

Goldsmith

[11] Patent Number: 5,669,588

[45] Date of Patent: Sep. 23, 1997

[54] MOTION BARRIER

[76] Inventor: Michael A. Goldsmith, 75-58 192nd St., Flushing, N.Y. 11366

[21] Appl. No.: 703,382

[22] Filed: Aug. 26, 1996

[51] Int. Cl.[6] ..... B61B 1/02

[52] U.S. Cl. ..... 246/307; 246/297; 246/313; 104/28

[58] Field of Search ..... 246/270 R, 292, 246/293, 297, 304, 309, 313, 473.1, 307; 104/28, 30; 105/341

[56] References Cited

U.S. PATENT DOCUMENTS

| | | | |
|---|---|---|---|
| 1,194,761 | 8/1916 | Matthias | 246/313 |
| 3,964,704 | 6/1976 | Karr | 246/125 |
| 4,090,685 | 5/1978 | Pappas | 246/125 |
| 4,369,943 | 1/1983 | Hussein | 246/127 |
| 4,666,108 | 5/1987 | Fox | 246/125 |
| 5,118,056 | 6/1992 | Jeanise | 246/127 |
| 5,176,082 | 1/1993 | Chun et al. | 104/28 |
| 5,454,327 | 10/1995 | Goirand | 104/28 |

FOREIGN PATENT DOCUMENTS

| | | | |
|---|---|---|---|
| 9061 | 2/1887 | United Kingdom | 246/313 |

*Primary Examiner*—S. Joseph Morano

[57] ABSTRACT

A safety device for train passengers which permits barriers to rise and lower as trains (66) pass. Ridge posts (58) are secured by ridge post mounts (64) on a train undercarriage (68). Ridge wheels (60) spins on the ridge posts (58). As the train (66) moves into a train station, the ridge wheels (60) will first encounter an inclined ramp guide (1) or a mechanical ramp guide (52) and spin along the spin wheel ridge (4), causing the motion barrier wall (2) to move downward, below the platform level (10). As the motion barrier wall (2) moves downward, its support system, pole spring units (12) or cylinder spring units (22) will be compressed into underground chambers. As the train (66) leaves the train station the ridge wheels (60) will continue spinning until the last car of the train (66) rolls off the end of the spin wheel ridge (4) and the ramp guide (1) or a mechanical ramp guide (52). At this point, the motion barrier wall (2) would have returned to its normal resting position above the platform level (10) and cylinder spring units (22) or pole spring units (12) would have expanded out of pole spring chambers (28), cylinder spring chambers (40) or barrier slots (70).

4 Claims, 5 Drawing Sheets

MOTION BARRIER

BACKGROUND—FIELD OF INVENTION

This invention relates to barriers, specifically to such barriers that will rise and lower as trains pass.

BACKGROUND—DESCRIPTION OF PRIOR ART

Presently, there is a great need for a safety system for train passengers. Unfortunately, a passenger's trip frequently ends in disaster, when one trips, loses their balance or is pushed onto a train's tracks.

Safety devices in the form of barricades and crossing gates have been utilized in prior art. U.S. Pat. No. 5,118,056 to Jeanise (1992), which is a "barricade apparatus", that raises to a above ground level to barricade railroad crossings. U.S. Pat. No. 4,666,108 to Fox (1987), U.S. Pat. No. 3,964,704 to Karr (1976), U.S. Pat. No. 4,090,685 to Pappas (1978) and U.S. Pat. No. 4,369,943 to Hussein (1983) all utilize a crossing gate device to serve as traffic barriers.

The prior art's mentioned scope of protection is limited to a very small specified area, at intersections and railroad crossings.

Another disadvantage is that the prior art is dependent on a power source. Additionally, the barriers are only present when an oncoming vehicle is about to pass (dangers exist moments before). These barriers grossly overlook a daily hazard faced by millions of people everyday.

OBJECTS AND ADVANTAGES

Accordingly, several objects and advantages of my invention are:

(a) to provide a barrier between passengers and trains;

(b) to provide a barrier that only lowers when the train pulls into the station;

(c) to provide a barrier that raises when a train leaves the station;

(d) to provide a barrier that is not reliant on a power source;

(e) to provide a barrier that is operational in both subways and above ground trains;

(f) to provide a barrier in which all moving parts are kept away from passengers;

(g) to provide a barrier that submerges under the train and platform when passengers are entering (or exiting);

(h) to provide a barrier that could cover part or all of the platform;

(i) to provide a barrier that is operational as one solid unit or several connecting units;

(j) to provide double-decker (tier) barriers when space is limited.

Further objects and advantages are to provide a barrier that keeps debris off the train tracks, while serving as a bulletin board for important messages. Still further objects and advantages will become apparent from a consideration of the ensuing description and drawings.

DRAWING FIGURES

Reference Numerals In Drawings

| | |
|---|---|
| 1 incline ramp guide | 2 motion barrier wall |
| 4 spin wheel ridge | 6 connector pin |
| 8 connector bracket | 10 platform level |
| 12 pole spring unit | 14 train track level |
| 16 upper pole | 17 lower pole |
| 18 external spring | 20 internal spring |
| 21 oversized internal spring | 22 cylinder spring unit |
| 24 cylinder upper half | 25 cylinder lower half |
| 26 top absorber | 28 pole spring chamber |
| 30 pole spring base | 32 pole spring cavity |
| 34 train level plate | 36 bolts |
| 38 pole spring plate | 40 cylinder spring chamber |
| 41 guide bracket | 42 train tracks |
| 44 cylinder spring plate | 45 cylinder top absorber |
| 46 upper gap ridge | 48 lower gap ridge |
| 49 tier one wall | 50 double tier motion barrier wall |
| 51 tier two wall | 52 mechanical ramp guide |
| 54 hookeye | 56 pinbolt |
| 58 ridge post | 59 grip contour |
| 60 ridge wheel | 62 ball bearings |
| 64 ridge post mount | 66 train |
| 68 train undercarriage | 70 barrier slot |

DESCRIPTION-FIGS.1 TO 8

Figure 1:
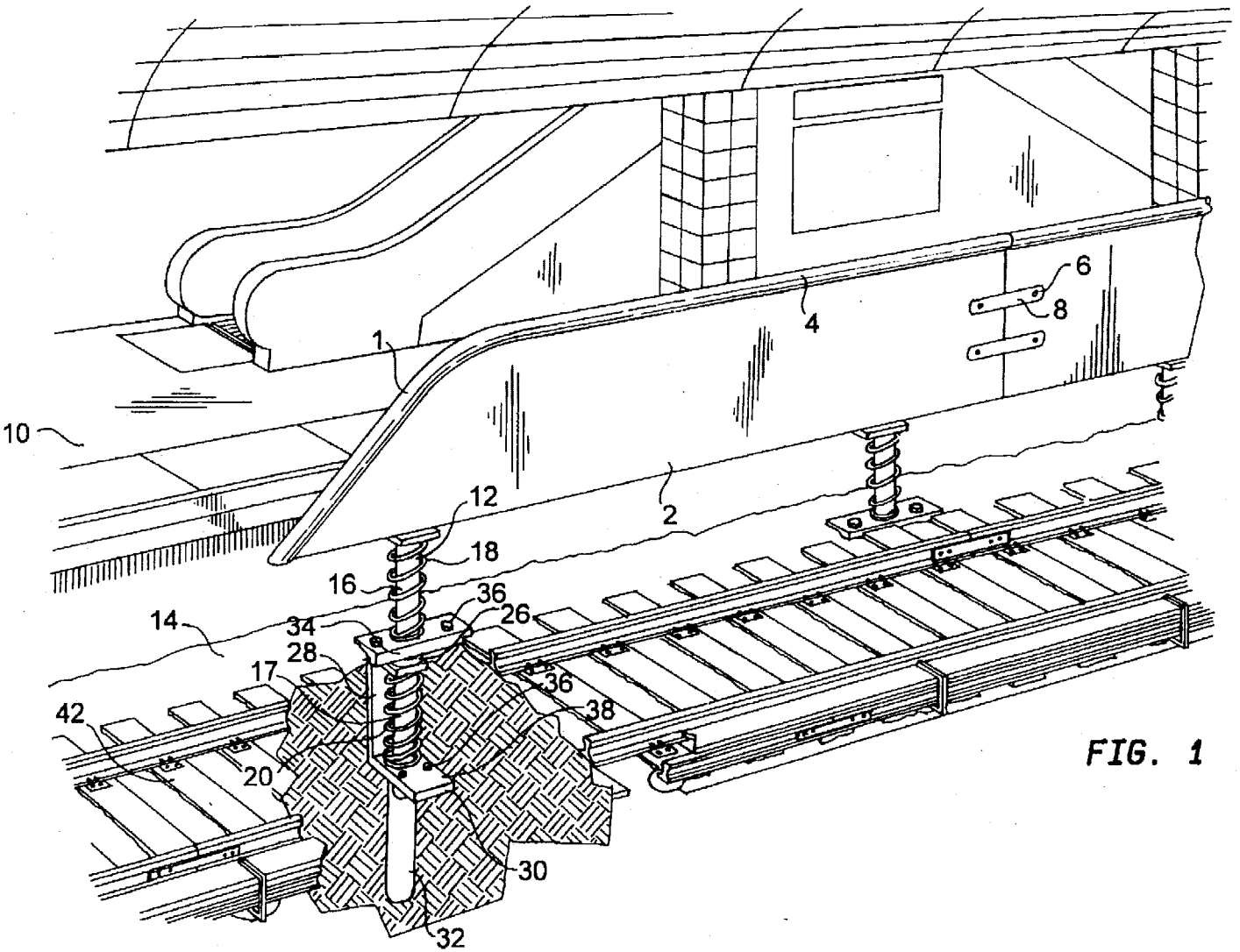
FIG. 1 shows a motion barrier wall which has expanded from a train track supported by pole spring units.
Figure 2:
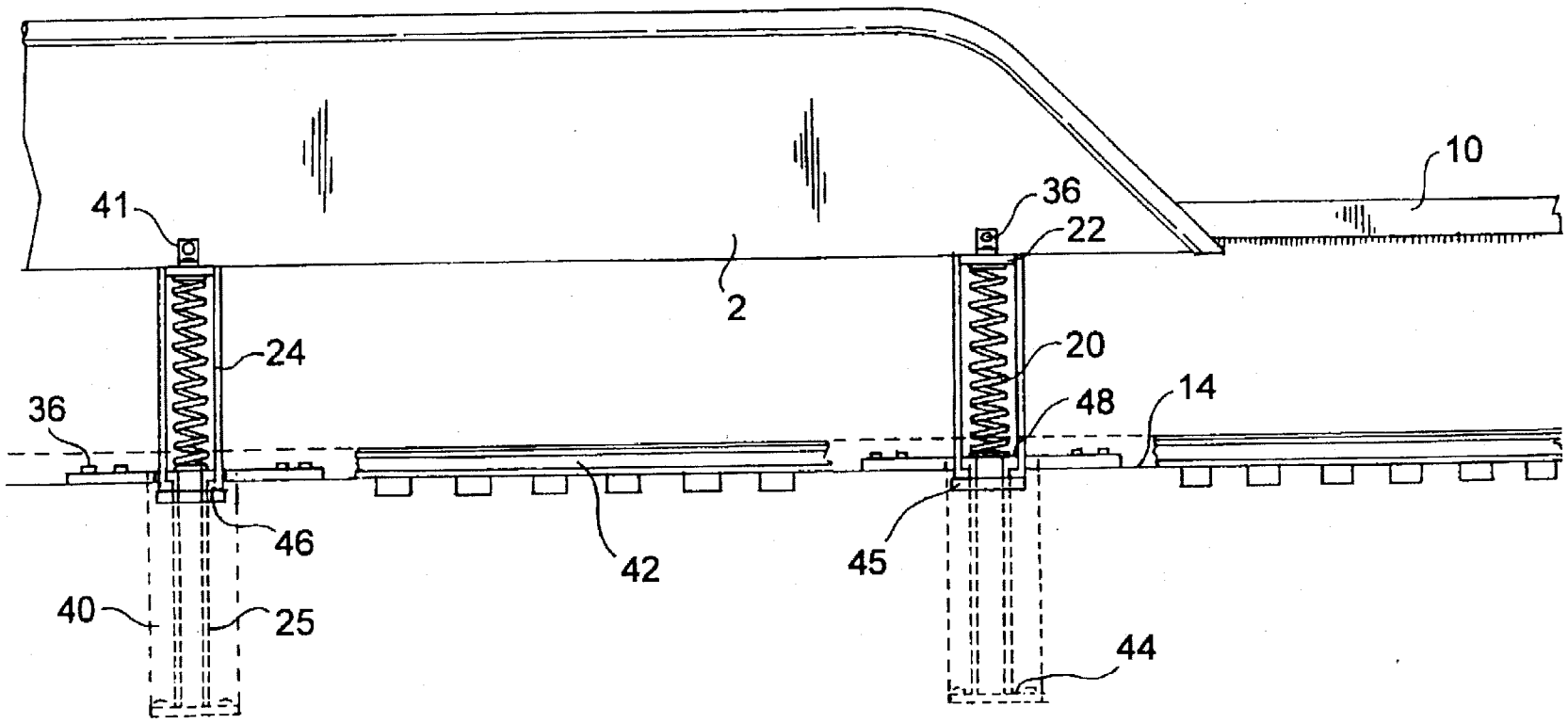
FIG. 2 shows a motion barrier wall which has expanded from a train track supported by cylinder spring units.

FIG. 1 and FIG. 2 shows overall views of a motion barrier wall 2 expanded from a train track(s) 42. FIG. 1 shows a spin wheel ridge 4 which runs along the top of a motion barrier wall 2 until reaching the end at a incline ramp guide 1. (A motion barrier wall 2 could be made out of metal, hard rubber, fiberglass, plastic, etc.) A motion barrier wall 2 is connected to another motion barrier wall 2 by a connector bracket 8 and a connector pin 6. A motion barrier wall 2 is connected to a upper pole 16. A upper pole 16 is surrounded by a external spring 18. A upper pole 16 is connected to a top absorber 26, (a top absorber 26 can be made out of metal, fiberglass, plastic, wood with a rubber covering). A top absorber 26 is connected to a lower pole 17. A lower pole 17 is surrounded by an internal spring 20 and connects to two areas, a pole spring base 30 and a pole spring cavity 32. A pole spring base 30 is the bottom portion of a pole spring chamber 28. A pole spring chamber 28 is connected on top to a train level plate 34. Bolts 36 are connected to a train level plate 34.

FIG. 2 shows a cylinder spring unit 22 (in place of a pole spring unit 12 as shown in FIG. 1). A motion barrier wall 2 is connected to a guide bracket 41. A guide bracket 41 is connected to a cylinder upper half 24. On the bottom of a cylinder upper half 24 an upper gap ridge 46 connects to a lower gap ridge 48 internally. Externally, on the bottom of a cylinder upper half 24 is a cylinder top absorber 45. On the bottom of a lower gap ridge 48 a cylinder lower half 25 connects to bolts 36. A bolt 36 connects to a cylinder spring plate 44.

Figure 3:
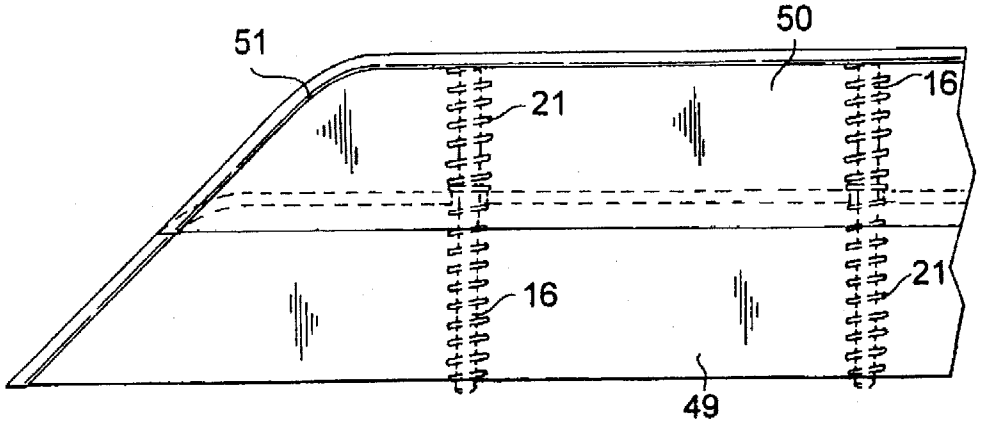
FIG. 3 shows a double tier motion barrier wall supported by pole spring units.

FIG. 3 shows a view of a double tier motion barrier wall 50. A tier two wall 51 is connected to a upper pole 16. A upper pole 16 is connected to an oversized internal spring 21, which is connected to the top of a tier one wall 49. A tier one wall 49 is connected to an upper pole 16 (just mentioned). An upper pole 16 is connected to another oversized internal spring 21 which connects to a bottom of a tier one wall 49. Below a tier one wall 49, an upper pole 16 continues and connects to a pole spring unit 12.

Figure 4:
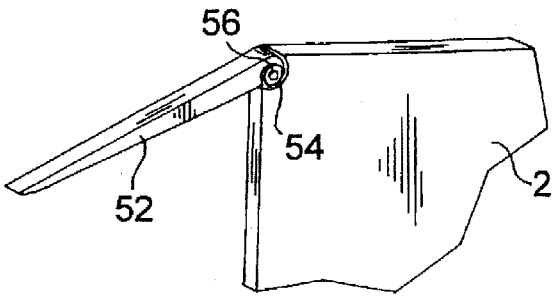
FIG. 4 shows a mechanical ramp guide attached to a motion barrier wall.
Figure 5:
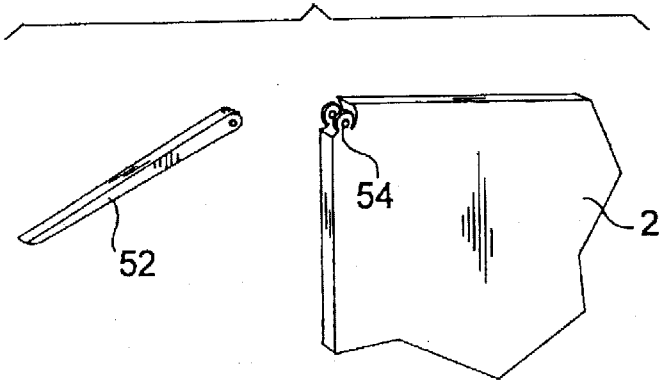
FIG. 5 shows a mechanical ramp guide detached from a motion barrier wall.

FIG. 4 and FIG. 5 show different positions of a mechanical ramp guide 52 and a motion barrier wall 2. In FIG. 4, a mechanical ramp guide 52 connected to a pin bolt 56 is connected to a hookeye 54. A hookeye 54 is attached to a motion barrier wall 2. In FIG. 5 a mechanical ramp guide 52 is shown disconnected from a pinbolt 56, hookeye 54 and a motion barrier wall 2.

Figure 6:
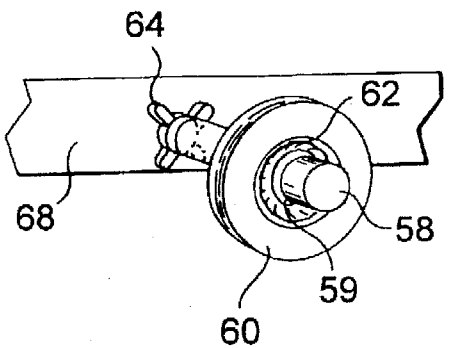
FIG. 6 shows a ridge wheel mounted on a ridge post and attachment to a train undercarriage.

FIG. 6 shows a ridge wheel 60. Ball bearings 62 the internal mid-section of a ridge wheel 60. A ridge wheel 60 is connected a ridge post 58, the point of intersection is at a grip contour 59, (which is the grooved indented portion of a ridge post 58). A ridge post 58 is connected to a ridge post mount 64. A ridge post mount 64 is connected to a train undercarriage 68.

Figure 7:
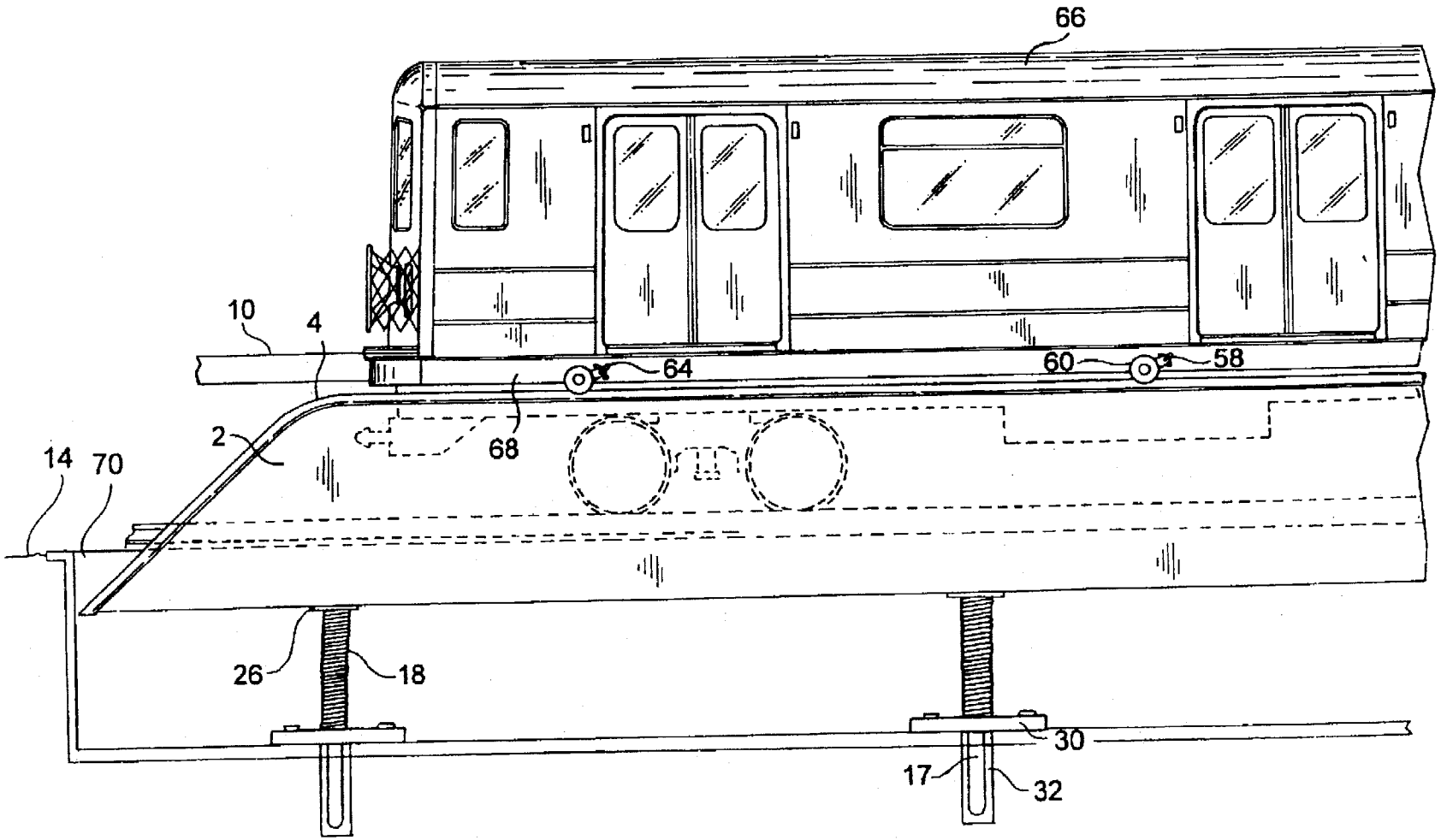
FIG. 7 shows a motion barrier wall being compressed by a train into a barrier slot.

FIG. 7 shows a train 66 and barrier slot 70. A train 66 is connected to a train undercarriage 68 which is connected to a ridge post mount 64. A ridge post mount 64 is connected to a ridge post 58 which connects to a ridge wheel 60. A ridge wheel 60 has a temporary connection with a spin wheel ridge 4, which is the top portion of a motion barrier wall 2. A motion barrier wall 2 is connected directly to a top absorber 26 (eliminating an upper pole 16 and an internal spring 20 of a pole spring unit 12). A top absorber 26 is attached to a lower pole 17 and an external spring 18. A lower pole 17 fills a pole spring cavity 32, while an external spring 18 is connected to a pole spring base 30. A pole spring base 30 rests on the base of a barrier slot 70.

Figure 8:
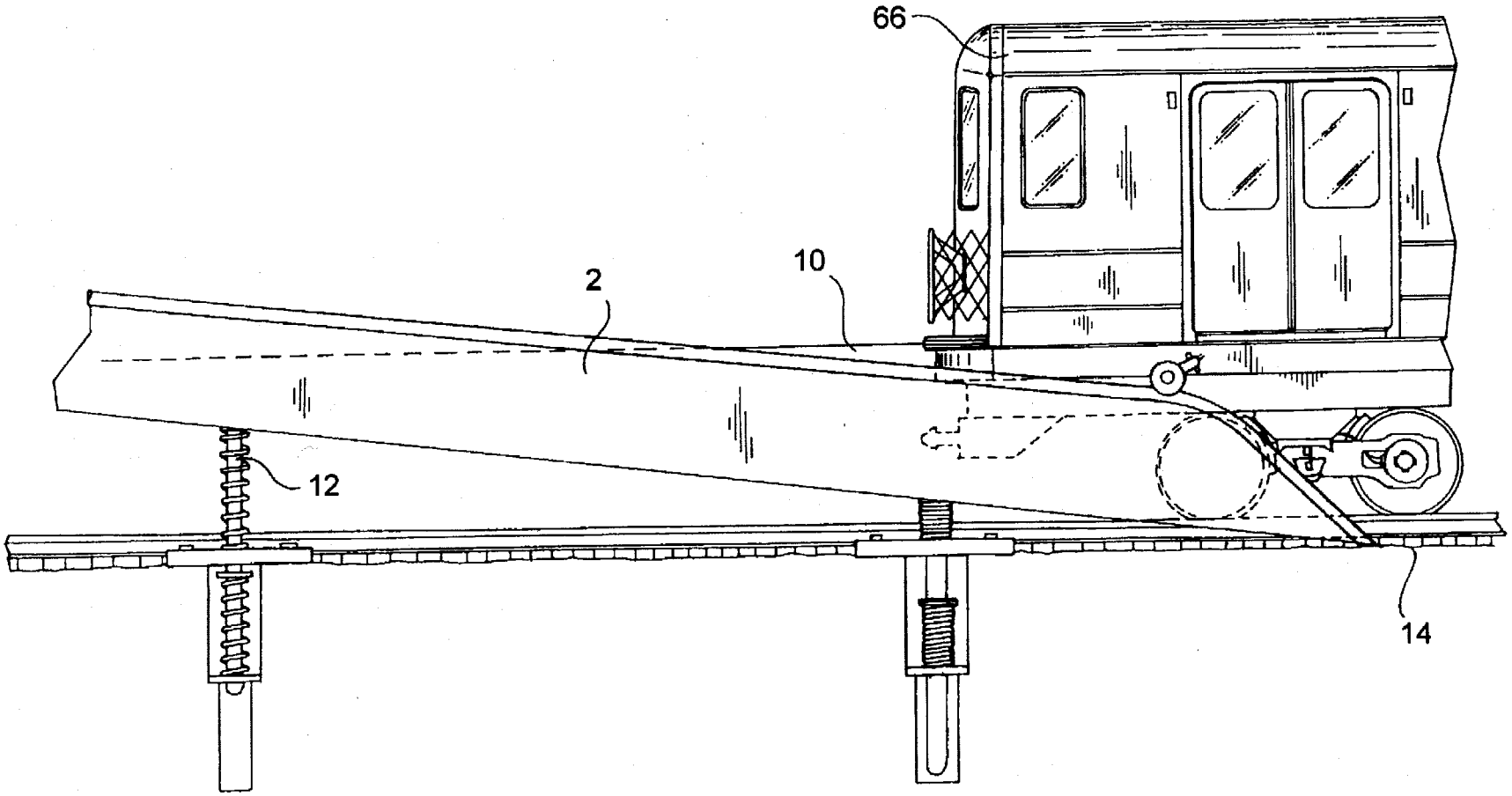
FIG. 8 shows a motion barrier wall and pole spring units being compressed by a train.

FIG. 8 is almost identical to FIG. 1. The only difference is the addition of train 66, showing compression of motion barrier wall 2 and pole spring units 12.

From the description above, a number of advantages of my motion barrier become evident:

(a) Motion barrier walls could operate at any length and height.

(b) Motion barrier walls only lowers when a train is directly in front of passengers.

(c) Motion barrier walls raise as a train leaves a train station.

(d) All parts are accessible for maintenance.

(e) Motion barrier walls are operational at either end with the use of either incline ramp guide or mechanical ramp guide.

(f) The varied use of cylinder spring units, pole spring units, and barrier slots will allow operation in any given train station.

(g) A new revenue source will be created as motion barrier walls could be used for advertisements.

Operation-FIGS. 1–8

The manner of operation of the motion barrier is quite simple. The motion barrier wall 2 will remain upright and extend over the platform level 10 until it comes in contact with a train 66. When contact occurs, the motion barrier wall 2 will be compressed underneath the platform level 10, until the train 66 leaves the train station.

In FIGS. 1, 6 and 8 one would see how the components, compression and expression of a motion barrier wall 2 and a pole spring unit 12 would interact. A pole spring unit 12 refers to an external spring 18, internal spring 20, upper pole 16 and a lower pole 17. A train 66 would roll along train tracks 42 and encounter a motion barrier at a train station. The ridge wheels 60 of train 66 would roll onto an inclined ramp guide 1. (A ridge wheel 60 has a concave exterior to grip a incline ramp guide 1. The mid-section of a ridge wheel 60 contains ball bearings 62 to reduce friction. The ridge wheel 60 rotates on a ridge post 58, (held in place by a grip contour 59, a grooved indented portion on a ridge post 58). The ridge post 58 is secured by ridge post mounts 64 on the train undercarriage 68. As the ridge wheels 60 continue rolling along the spin wheel ridge 4, the motion barrier wall 2 would be forced underneath platform level 10, (out of the view of the passengers allowing them to board the train 66. This action will cause the pole spring unit 12 to compress, (shown in FIG. 8). In greater detail, this action will cause downward compression of the external spring 18 into the top of the train level plate 34 and the upper pole 16 to lower into the pole spring chamber 28. As motion continues, the internal spring 20 will compress downward into the top of the pole spring base 30 and the lower pole 17 will be pushed through the space in the pole spring base 30 filling the pole spring cavity 32. A pole spring chamber 28 is carved out (underground) from the train track level 14. The compressed internal spring 20 is secured on bottom by pole spring base 30 and on top by train level plate 14 and top absorber 26. Both the pole spring base 30 and the train level plate 14 are secured by bolts 36. As a train 66 leaves the station, the pole spring unit 12 will expand upward. As the upward expansion causes the lower pole 17 to rise up from the pole spring cavity 32 and the internal spring 20 will expand to fill the pole spring chamber 28. The external spring 18 and upper pole 16 will move upward to push the motion barrier wall 2 back over the platform level 10. (Each time upward expansion occurs the motion will be softened by a top absorber 26, made out of rubber.) Complete upward expansion is shown in FIG. 1. The usefulness of the pole spring unit 12 is displayed as it is able to expand and contract through many levels of underground structures.

Also shown in FIG. 1 is a connector bracket 8 which serves to connect long stretches of motion barrier walls 2, held by connector pins 6. Long extended motion barrier walls 2 would need to be built for larger stations. Either end of the motion barrier wall 2 would have the same downward slope (incline ramp guide 1) to enable a train 66 to approach a station from either direction.

FIG. 2 shows a fully expanded motion barrier wall 2 similar to FIG. 1, except in FIG. 2 a cylinder spring unit 22 replaces a pole spring unit 12. A cylinder spring unit 22 refers to its main components, a cylinder upper half 24, cylinder lower half 25, and internal spring 20. A motion barrier wall 2 rests on top of cylinder upper half 24 held in place by bolts 36 and guide bracket 41. The operation of a cylinder spring unit 22, again utilizes springs to lift the motion barrier wall 2 over the platform level 10 at a train station. A cylinder top absorber 45 (can be made out of rubber) grips and prevents the cylinder upper half 24 from rising out of the cylinder spring chamber 40. A upper gap ridge 46 (located on the bottom of a cylinder upper half 24) and a lower gap ridge 48 (located on the top of a cylinder lower half 25) are oversized ridges around the edge preventing the two halves from separating. As a train 66 would approach motion barrier wall 2, downward pressure would force the cylinder spring units 22 to be compressed. When compression occurs, a cylinder upper half 24 would move downward into the cylinder spring chamber 40. The internal spring 20 would compress on the top of cylinder lower half 25 and the motion barrier wall 2 would fall below platform level 10. At this point, passengers could board train 66. The cylinder lower half 25 is secured to cylinder plate 44 by bolts 36. (The bottom of cylinder lower half 25 has a flat extending base which allows it to be secured by bolts 36.) As train 66 leaves the station the same reactions would occur, only in reverse. The internal spring 20 would expand out of cylinder spring chamber 40 and the motion barrier wall 2 would rise and again serve as a barrier (between platform and train tracks 42). Cylinder spring units 22 would be used in areas where downward construction would be limited.

In FIG. 7, the same principles of compression are being demonstrated with slight modifications. A motion barrier wall 2 has been compressed into a barrier slot 70. (A barrier slot 70 is a narrow slot cut into the train track level 14.) A motion barrier wall 2 is supported by a top absorber 26, an external spring 18 and a lower pole 17. As mentioned earlier, with spring units 12, when compressed the lower pole 17 would move into a pole spring cavity 32. When train 66 leaves, expansion would take place as the lower pole 17 and the motion barrier wall 2 would rise. The barrier slot 70 provides another important solution to deal with various space/ground situations.

In FIG. 3, a double tier motion barrier wall 50 is displayed. A double tier motion barrier wall 50 allows the barrier height to be dramatically increased. The same principles of compression and expansion would apply as mentioned earlier. A double tier motion barrier wall 50 is essentially a motion barrier wall 2 with an extra level which utilizes a pole spring unit 12, an extended upper pole 16 (running through both levels), and oversized internal springs 21. As compression takes place, the tier two wall 51 would be pushed downward overlapping tier one wall 49, the oversized internal springs 21 would be compressed into each level (tier two and one) and the upper pole 16 and external spring 18 would move downward. Expansion would trigger the same reactions, only in reverse (as mentioned in previous examples).

In FIG. 4 and FIG. 5, a motion barrier wall 2 is shown with a mechanical ramp guide 52. As a ridge wheels 60 runs along the top of the mechanical ramp guide 52, the mechanical ramp guide 52 will pivot on a pinbolt 56 (supported by a hookeye 54) and force the motion barrier wall 2 downward. A mechanical ramp guide 52 is great for train track levels 14 which have rough or uneven surfaces.

SUMMARY RAMIFICATIONS, AND SCOPE

Accordingly, the reader will see that the motion barrier operates easily, provides high levels of safety, while it can function and be built to match the demands of any train station. Furthermore, the motion barrier has additional advantages in that

- it will save lives;
- it allows a train to approach either end of an inclined ramp guide, (or mechanical ramp guide);
- it lowers overall operating cost by reducing lawsuits, (passengers will now be shielded from the dangers of train tracks);
- it also lowers overall operating cost by reducing the need to clean train tracks (debris will be kept off tracks);
- it requires no power source to operate (only movement of a train); and
- it provides a new revenue source as the motion barrier wall could be used as a billboard for advertising.

Although the description above contains many specificities, these should not be construed as limiting the scope of the invention but as merely providing illustrations of some of the presently preferred embodiments of this invention. For example, the combinations and materials of the motion barrier's components could be numerous as long as they attribute to the operation or structure. One of many examples could be adding or eliminating, external/internal springs to pole spring units, cylinder spring units or adding a upper pole to function with a barrier slot, or to recombine elements of cylinder spring units with pole spring units. The motion barrier could be constructed out of metals, plastics, woods or rubbers. Motion barriers walls could be lengthened, height raised, made narrower or wider. Motion barrier walls could be a single tier, double tier or a triple tier. Cylinder spring chambers, pole spring chambers and barrier slots could be made deeper or smaller. The connections between sections of motion barrier walls doesn't necessarily have to be completed with connector brackets, another good use could be springs. The properties of the springs and ridge wheels could be could be varied in material and use. In place of ridge wheels, levers or other gripping devices could also be used. Other securing agents could be used in place of bolts, for example screws, welding, pins, . . . etc.

Thus the scope of the invention should be determined by the appended claims and their legal equivalents, rather than by the examples given.

I claim:

1. A railway motion barrier system comprising:

a motion barrier wall, at least one spring unit affixed to said motion barrier wall to bias said motion barrier wall upward above a platform level, a spring unit reception area for receiving said at least one spring unit, at least one ridge wheel affixed to a train, said ridge wheel compressing said spring unit into said spring reception area by rolling on said motion barrier wall when said train enters a location adjacent said motion barrier wall, such that said motion barrier wall is compressed below the platform level, and said at least one ridge wheel releasing said compressed spring unit from said spring reception area by rolling off said motion barrier wall when said train leaves the location adjacent said motion barrier wall, such that said motion barrier wall is returned upward above the platform level.

2. The railway motion barrier system according to claim 1, wherein said at least one spring unit comprises a cylinder spring unit, and said spring reception area comprises a cylinder spring chamber.

3. The railway motion barrier system according to claim 1, wherein said at least one spring unit comprises a pole spring unit, and said spring reception area comprises a pole spring chamber.

4. The railway motion barrier system according to claim 1, wherein said spring reception area comprises a barrier slot.

* * * * *